United States Patent [19]

Judson, Jr.

[11] 4,336,910

[45] Jun. 29, 1982

[54] MILLING APPARATUS

[76] Inventor: Carl Judson, Jr., Rte. 2, Livermore, Colo. 80536

[21] Appl. No.: 184,769

[22] Filed: Sep. 8, 1980

[51] Int. Cl.[3] ..... B02C 23/02

[52] U.S. Cl. ..... 241/246; 241/60; 366/329

[58] Field of Search ..... 241/82.1, 82.7, 58, 241/60, 245, 246; 366/79, 80, 81, 87, 309, 311, 313, 320, 329

[56] References Cited

U.S. PATENT DOCUMENTS 2,063,266 12/1936 Pape et al. ..... 366/79 X 2,567,523 9/1951 Moore ..... 366/81

2,572,063 10/1951 Skipper ..... 366/139 X 3,817,498 6/1974 Frankfurth et al. ..... 366/309 X

*Primary Examiner*—Eugene F. Desmond

*Attorney, Agent, or Firm*—Hugh H. Drake

[57] ABSTRACT

A milling apparatus receives solidifiable material and mixes it so as to achieve comminution and blending thereof. Disposed adjacent to the receiving enclosure is a vacuum chamber associated with a port that communicates between the chamber and the enclosure. Movable within that port, in correlation with operation of the mixer, is an agitator of portions of the material which tend to lodge within the port.

6 Claims, 9 Drawing Figures

MILLING APPARATUS

The present invention pertains to milling apparatus. More particularly, it relates to a pugmill or the like for processing ceramic potting materials and which achieves improved de-airing of the material being processed.

The art of making pottery is an historic one. At a very early date, it was learned that various clays could be molded and thus used to form utensils for such purposes as storing water and containing foodstuffs being cooked. In time, the potting wheel was conceived and used. It enabled an operator to spin a clay-like material with a circular motion so as to facilitate the formation of round objects such as pots. Eventually, various machinery appeared in the field for such purposes as mixing the clay-type material and driving the potting wheel.

Similar history and other considerations involved in the pottery field may be found in a publication entitled "A Production Potter's Notebook" by Carl and Jeanne Judson, first published in 1977 and later in revised form in 1979, all as now incorporated in Bluebird Catalog No. 5 published in about December of 1979 by Bluebird Manufacturing Co., P.O. Box 2307, Ft. Collins, Colo. 80522.

The aforesaid publication includes descriptions of several pugmills available to the potter for processing the clay-like material. It had been found early in the art that a superior ultimate product resulted when the clay-type material first was "wedged" in order to work out air bubbles and also to obtain a consistent blending of any variation of material components. Originally, this wedging was accomplished by use of the hands to thoroughly knead the raw material.

More recently, the field has used a pugmill for the purpose of wedging and blending the material before it is employed on the potting wheel or otherwise to form the final product. A form of pugmill which has found widespread acceptance is shown and discussed in the aforesaid publication. It features a hopper into which the raw material is received, an auger for moving the material away from the hopper and through shredding screens and an outlet or nozzle which ultimately delivers a "pug" of the material ready for the final molding of the clay on the potter's wheel or for hand forming an object.

For most kinds of materials to be processed, those pugmills have performed admirably for what now is a substantial period of time. The inherent operation of the internal auger, which both chops the material and pushes it through shredding screens, tends to achieve a high degree of both the desired combination and also the kneading necessary to work out entrained air. However, some compositions of clay or other materials, such as porcelain, rather tenaciously tend to maintain an undesired degree of air entrainment as a result of which the ultimate product might include a structurally-weakened segment arising from an air pocket or the final shaping of the product may be rendered at least more difficult.

In resolution of the described problem, it previously has been proposed to connect a source of negative pressure or vacuum to the main chamber of the pugmill. An example of this approach will be observed in an advertisement which appeared at page 8 of *Ceramics Monthly* for February, 1980. The imposition of the vacuum, of course, tends to draw air out of the mixture being processed within the pugmill. In seeking to evacuate air from the mixture, however, the same negative pressure that seeks to withdraw the entrained air from the mixture also tends to pull portions of the main mixture into the evacuation apparatus. That too quickly leads to clogging of the vacuum system.

Of course, clogging in various apparatus that handles raw materials, which may have a "sticky" consistency, has long been recognized. Examples of solutions to such problems may be found in U.S. Pat. Nos. 2,587,127-Erickson et al, 2,692,125-Light, 3,934,858-Parsonage et al and 4,067,483-Mucke. Erickson et al used a valve-control air escape, while Light articulated a scraper element inside a mixing chamber. Parsonage et al employed a rotatable arm adjacent to an inlet for a material in order to avoid clogging. Mucke employed flexible wiper fingers to wipe out pockets at a point of gravity discharge of a plastic from a metering region. Unfortunately, none of these prior art teachings addressed the specific problem presented by use of a negative pressure to disentrain air from the very material which would cause clogging problems.

Accordingly, it is a general object of the present invention to provide milling apparatus that better achieves results heretofore sought in the art and yet which avoids problems that have continued therein.

Another object of the present invention is to provide new and improved de-airing pugmills.

A further object of the present invention is to provide new and improved apparatus which achieves the desired new degree of satisfactory performance without adding unduly to cost.

Milling apparatus constructed in accordance with the foregoing objects involves an enclosure within which a solidifiable material is received. Disposed within that enclosure is a mixer which effects comminution and blending of the material and ultimate delivery thereof out of the enclosure. Disposed adjacent to the enclosure is a chamber in which there is induced a negative pressure. A port communicates between the chamber and the enclosure. Movable within that port, and in correlation with operation of the mixer, is an agitator of portions of the material which tend to lodge within the port.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
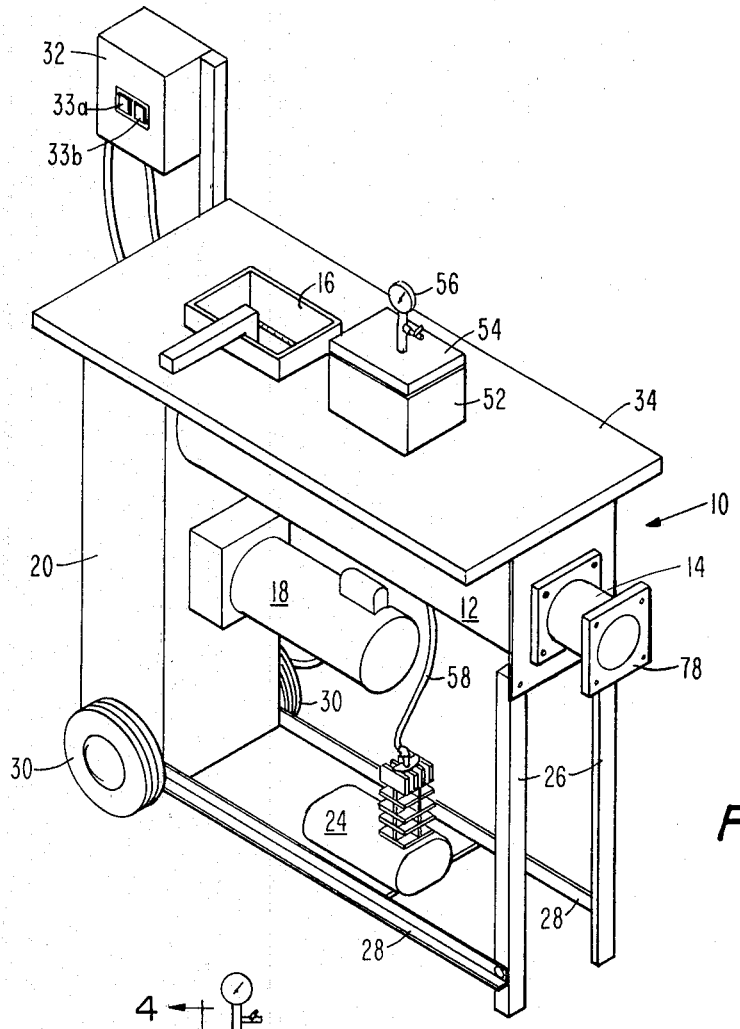
FIG. 1 is an isometric view of an embodiment of the present invention.
Figure 2:
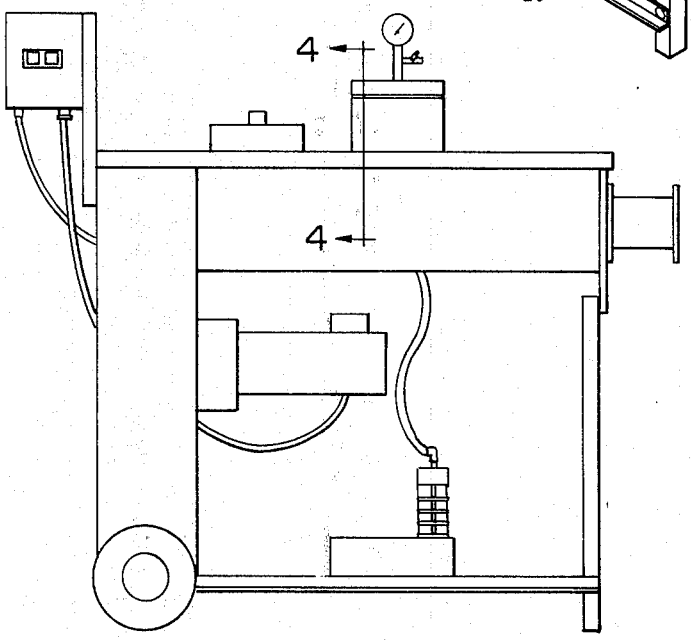
FIG. 2 is a side elevational view thereof.
Figure 3:
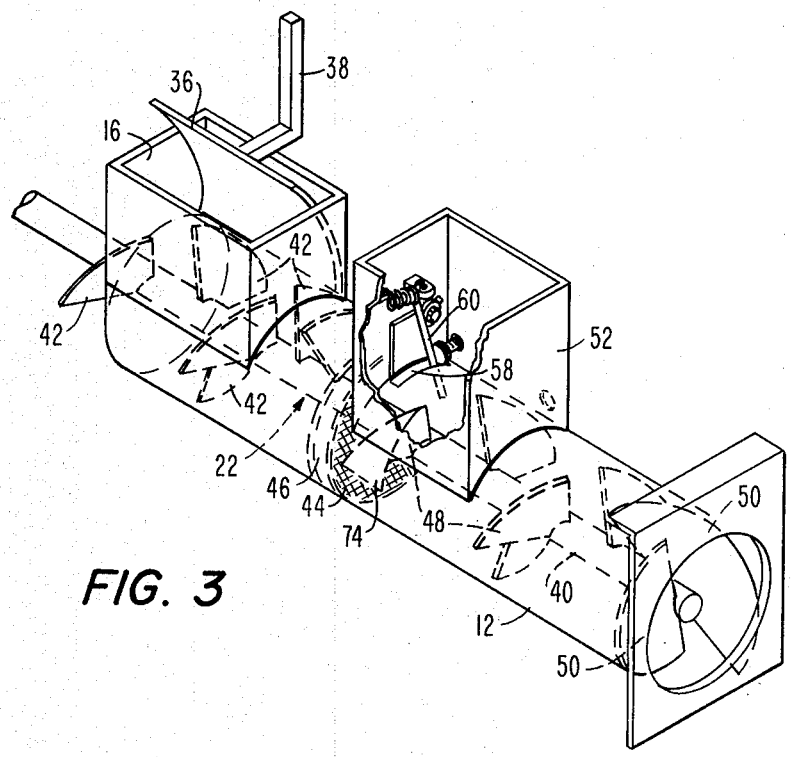
FIG. 3 is an isometric view of a sub-assembly included within the apparatus of FIG. 1.

A pugmill 10 includes as basic components a barrel 12, an extruding nozzle 14 at one end of barrel 12, a hopper 16 that allows molding clay or the like to be inserted into one end of barrel 12, a driving motor 18, a housing 20 for shielding a drive linkage that couples motor 18 to an auger 22 rotatable within barrel 12 and a vacuum pump 24. This assemblage is tied together by upright struts 26 connected to rails 28 that project outwardly from housing 20 underneath which dolly wheels 30 are situated. Supported above one side of housing 20 is a box 32 that preferably encloses the usual overload-protecting circuitry for motor 18 and carries an operator-available plurality of switches 33*a* and 33*b* for governing operation of motor 18 and vacuum pump 24. A table top 34 disposed above barrel 12 has an opening which accommodates hopper 16 and provides a work surface for the user.

Hopper 16 is open at its bottom for dispensing a material such as clay into the end of barrel 12 adjacent to housing 20. A pressure plate 36, having a handle 38, fits within the upwardly facing opening of the hopper so as to enable the user to press the material downwardly and into barrel 12. A lock may be included for securing pressure plate 36 in covering position over the opening in the bottom of hopper 16. Disposed longitudinally within barrel 12 is a rotatable shaft 40 which projects away from housing 20. Within housing 20, shaft 40 is coupled through suitable gearing and/or a chain and sprocket linkage (not shown) so as to be driven in rotation by motor 18. Of course, shaft 40 is supported at each of its opposing end portions on suitable bearings.

On a first length of shaft 40, closest to housing 20, are a plurality of laterally-extending chopping blades 42 individual ones of which are circumferentially spaced around shaft 40 and also spaced along its axial length. Rigidly affixed on shaft 40 somewhat intermediate its length is a shredding screen 44. Immediately behind screen 44, toward housing 20, are a pair of semi-circular pusher blades 46 each canted so as to force material, received by way of hopper 16, through screen 44.

Beyond screen 44, toward nozzle 14, there is a second plurality of chopping blades 48 affixed to shaft 40 rigidly and arranged in a pattern similar to that of blades 42. Adjacent to nozzle 14, there are an additional pair of canted, semi-circular blades 50 that push the received material on into nozzle 14. The entire assemblage, of barrel 12, shaft 40 and the different chopping blades 42 and 48 together with pusher blades 46 and 50, serves as an auger that comminutes and blends the received material and delivers it through nozzle 14.

Situated at the top of barrel 12 is a vacuum chamber 52 closed by a removable cover 54 and upon which is mounted a negative-pressure gauge 56 that communicates with the interior of chamber 52. A hose 58 leads from vacuum chamber 52 to vacuum pump 24.

Communicating between vacuum chamber 52 and the interior of barrel 12 is a comparatively narrow and circumferentially-delineated slot 58. As shown, slot 58 is located, along the length of barrel 12, just beyond shredder 44.

Projecting slightly through slot 58, from chamber 52 into the interior of barrel 12, is a finger 60. In this case, finger 60 is rigidly affixed to a collar 62 that rides on a pin 64 projecting outwardly from an end wall of chamber 52. However mounted, finger 60 is capable of being so moved that its free end oscillates back and forth within slot 58. In principle, the circumferential extent of slot 58 can be relied upon to limit the extent of swinging movement of finger 60. However, it has been found desirable to include an adjustable limiting stop 66, affixed to a sidewall of chamber 52 as illustrated, that precludes movement of finger 60 beyond a selected limit against the indicated direction of rotation of shaft 40.

Figure 4:
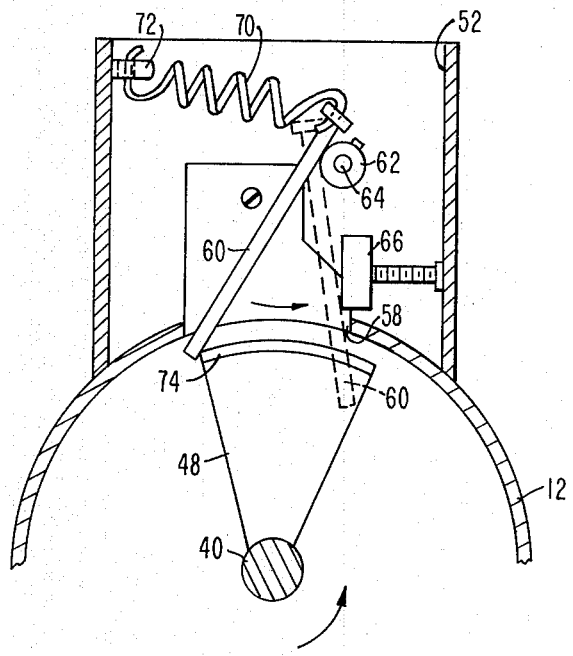
FIG. 4 is a fragmentary cross-sectional view taken along the line 4—4 in FIG. 2.

A spring 70 is coupled in tension between a lug 72, on the other sidewall of chamber 52, and the end of finger 60 which projects above pin 64, so as to cause finger 60 normally to be biased into the position illustrated by phantom-line representation in FIG. 4. In that position, finger 60 lies against stop 66.

Underlying slot 58, through which the free end of finger 60 projects within the interior of barrel 12, is one of chopping blades 48. Projecting axially of barrel 12 away from the outer end of that blade 48 is a cam 74. When shaft 40 is rotated so as to achieve the basic pug-milling operation, cam 74 is caused to repeatedly engage the free end of finger 60 and cause it to be moved throughout the extent of slot 58. After each passage of cam 74 beyond the free end of finger 60, spring 70 causes finger 60 to return to a more relaxed position against stop 66. The end result is a repetitive movement of the free end portion of finger 60 within slot 58. This keeps slot 58 free of clogging by the material.

The arrangement shown is one in which finger 60 is, in itself, rigid and its return after each camming is dictated by the tension in spring 70. In a proposed alternative, finger 60 is formed of a rod of metal or other material that contains its own resilience so as to return to an initial position after each camming operation. Moreover, a further alternative could involve a separate drive for finger 60 so that it oscillates within slot 58 in a manner quite independently of the operation of shaft 40 and its associated auger assemblage.

In use, the disclosed apparatus may be employed to wedge and measure clay or the like for throwing, the recycling of moist scraps, the changing of the clay body consistency or for the incorporation of grog into the body of clay. With different nozzle attachments, it may be used to extrude either solid or hollow shapes. That is, a plate 78, affixed on the output end of nozzle 14, generally may define a shape for the extruded pug in whatever form is desired. In any case, clay is to be first introduced into hopper 16 and pressed into the first set of chopping blades 42 by gentle use of pressure plate 36. As soon as the clay enters barrel 12, there is some removal of air from the mixture. Upon action by pusher blades 46 to force the mixture through shredder screen 44, an additional amount of the previously-entrained air is released and, immediately thereafter, removed from the system by the vacuum within chamber 52.

After still more chopping by blades 48, the mixture is forced off the final set of pusher blades 50 and through nozzle 14 which may constitute either a straight-through delivery path or be in the illustrated form of a tapered cone so as to concentrate the delivered pug. The ultimate result is the achievement of thorough wedging and blending with the removal of lumps and even allowing the introduction into hopper 16 of scraps leftover from a previous operation or the use of the machine also for the purpose of serving as a mixer of different components desired in the ultimate composition.

In use, the apparatus as described actually permits the buildup of a thin "skin" of the material on the interior surface of barrel 12. Although the outer peripheries of all of blades 42, 46, 48 and 50, as well as the circumferential periphery of screen 44, establish a rather close fit with the interior wall of barrel 12, that removable skin serves to optimize performance shortly after initial use.

The extruded material, in the form of the "pug", may either be stored for later use, directly thrown on a potter's wheel or employed in hand forming. There is a direction of spiral on the pug, imparted by the auger assemblage, and the user preferably places the pug section on the wheelhead so that the throwing action tightens the spiral.

It will be observed that the apparatus described permits the operator to attain the advantage of mechanization in wedging a body of clay or other similar material for the purpose of making pottery or other implements, devices or objects. At the same time, it incorporates the advantage of de-airing the processed mixture so as to further remove entrapped air which otherwise would remain within the mixture. Yet, the previously-entrained air is removed through a port system which is enabled to remain open for the withdrawal of air for a more-extended period of time.

While a particular embodiment of the invention has been shown and described, and various alternatives have been presented, it will be obvious to those skilled in the art that various changes and modifications may be made without departing from the invention in its broader aspects. Therefore, the aim in the appended claims is to cover all such changes and modifications as fall within the true scope and spirit of that which is patentable.

I claim:

1. Milling apparatus comprising:

an enclosure within which a solidifiable material is received;

mixing means disposed within said enclosure for effecting comminution and blending of said material and ultimate delivery of said material out of said enclosure;

a chamber disposed adjacent to said enclosure;

means for inducing a negative pressure within said chamber;

means defining a port communicating between said chamber and said enclosure;

and means movable within said port, in correlation with operation of said mixing means, for agitating portions of said material tending to lodge within said port.

2. Milling apparatus as defined in claim 1 in which said movable means is driven by said mixing means.

3. Milling apparatus as defined in claim 2 in which said mixing means includes an auger, and in which said movable means includes a finger projecting through said port and cammed into movement by an element on said auger.

4. Milling apparatus as defined in claim 3 which further includes means for resiliently biasing said finger to a first position and in which said element effects repetitive oscillation away from said first position to a second position.

5. Milling apparatus as defined in claim 3 which further includes means for adjusting a limit of said movement of said finger.

6. Milling apparatus as defined in claim 1 in which said mixing means includes a shredder of said material and in which said port is disposed downstream from said shredder in movement of said material through said mixing means.

* * * * *